US010288380B1

(12) United States Patent
York

(10) Patent No.: US 10,288,380 B1
(45) Date of Patent: May 14, 2019

(54) ENERGY TRANSFER INDICATOR

(71) Applicant: Sig Sauer, Inc., Newington, DE (US)

(72) Inventor: Andrew W. York, Portland, OR (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/049,525

(22) Filed: Jul. 30, 2018

(51) Int. Cl.

| | |
|---|---|
| ***F41G 3/12*** | (2006.01) |
| ***F41G 1/34*** | (2006.01) |
| ***F41G 1/38*** | (2006.01) |
| ***F41G 3/06*** | (2006.01) |

(52) U.S. Cl.
CPC ..... *F41G 3/12* (2013.01); *F41G 1/345* (2013.01); *F41G 1/38* (2013.01); *F41G 3/06* (2013.01)

(58) Field of Classification Search
CPC ..... F41G 3/08; F41G 3/12; F41G 1/38; F41G 11/00; G06F 3/002; G02B 27/00; G02B 27/0189
USPC ..... 42/119
See application file for complete search history.

(56) References Cited

U.S. PATENT DOCUMENTS

| | | | | |
|---|---|---|---|---|
| 6,886,287 | B1 * | 5/2005 | Bell | F41G 1/54 33/334 |
| 2007/0238073 | A1 * | 10/2007 | Portoghese | F41G 3/2605 434/21 |
| 2016/0252325 | A1 * | 9/2016 | Sammut | F41G 1/38 42/122 |
| 2016/0356577 | A1 * | 12/2016 | Kupiec | F41H 13/00 |
| 2017/0357002 | A1 * | 12/2017 | Winker | F41J 5/00 |

* cited by examiner

*Primary Examiner* — J. Woodrow Eldred
(74) *Attorney, Agent, or Firm* — Miller Nash Graham & Dunn LLP

(57) ABSTRACT

A system for indicating an energy transfer level having an optical sighting system and a mobile application running on a mobile device. The optical sighting system has an electronic, non-numeric performance indicator structured to provide a notification signal to a user. The mobile application is configured to receive a user input indicative of a desired terminal performance value for a projectile. The optical lighting system is configured to activate, when a predicted terminal performance value does not exceed the desired terminal performance value, an electronic, non-numeric performance indicator structured to provide a notification signal to a user. The electronic, non-numeric performance indicator may be an intermittently-displayed hold-over point indicator.

20 Claims, 8 Drawing Sheets

ENERGY TRANSFER INDICATOR

FIELD OF THE INVENTION

This disclosure is directed to a system and methods for providing information, particularly visual information, within an optical sighting system, such as a riflescope.

BACKGROUND

Riflescopes are mounted to rifles to assist in aiming the rifle to hit a desired target. Riflescopes may include reticles, which are markings or other indicators that appear in the field of view over the target's image through the riflescope. Reticles may include horizontal and vertical crosshairs with a central intersection point that can be calibrated to coincide with the point of impact of a projectile fired from the rifle. This central aiming point of the reticle may be zeroed-in at a particular zero-range distance and then adjusted for different ranges and conditions using elevation and windage turrets to make slight adjustments to its vertical and horizontal position relative to the rifle. In this way, the user may use the central intersection point of the crosshairs to aim the riflescope at the target.

As an alternative to the fine mechanical adjustments of elevation and windage turrets, some reticles are printed or formed with hold-over points, to use as aiming points instead of the central intersection point.

Embodiments of the disclosed systems and methods address shortcomings in the prior art.

DETAILED DESCRIPTION

As described herein, embodiments are directed to methods and apparatus for indicating an energy transfer level in an optical sighting system for a shooting device. In particular, shooters would like to ensure that the shooter is taking an ethical shot, especially game hunters aiming at a long-range target. This often means ensuring that the fired projectile, such as a bullet, has a minimum speed or kinetic energy upon arrival at the target. The speed or energy upon arrival is known as the terminal performance of the projectile. Accordingly, in embodiments the shooter may specify a desired minimum terminal performance of the projectile, and the optical sighting system will notify the shooter if the calculated terminal performance is less than the shooter's desired terminal performance. For example, one or more hold-over points in the reticle of the optical sighting system may flash to inform the shooter of the discrepancy. Consequently, embodiments of the disclosed technology allow shooters to easily make ethical choices while hunting.

The components of an example system are introduced separately below, before being discussed later in this disclosure.

Figure 1:
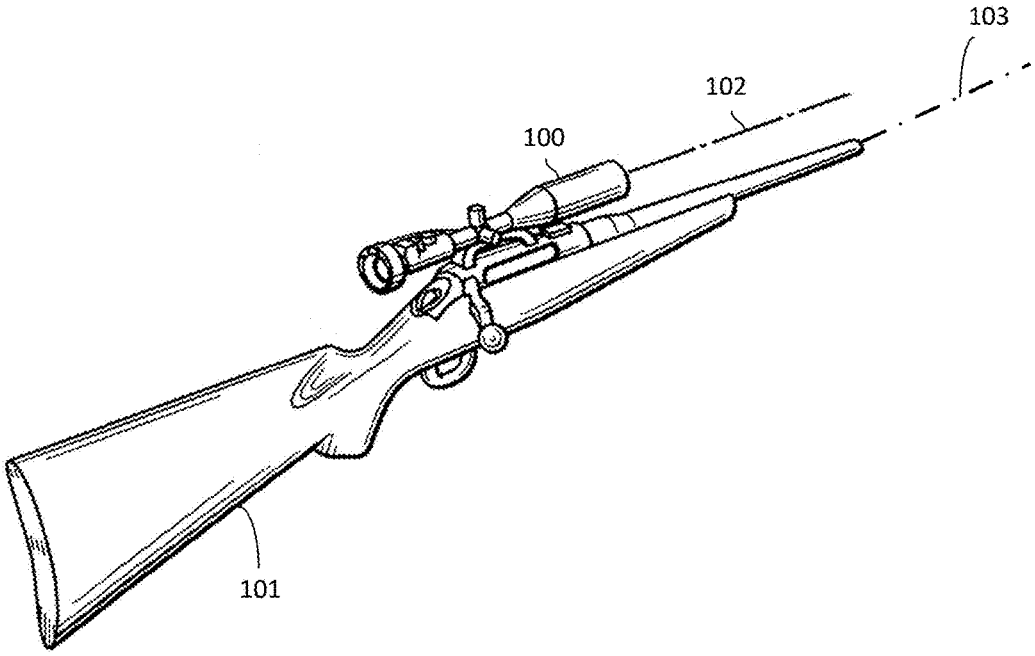
FIG. 1 is a perspective view showing an optical sighting system mounted to a shooting device, according to embodiments.

FIG. 1 is a perspective view showing an optical sighting system 100 mounted to a shooting device 101, according to embodiments of the disclosed technology. As illustrated in FIG. 1, an optical sighting system 100, depicted in FIG. 1 as a riflescope, may be mounted to a shooting device 101, depicted in FIG. 1 as a rifle. The optical sighting system 100 has an optical axis 102, sometimes referred to as the z axis. The barrel of the shooting device 101 has a bore line 103.

Figure 2:
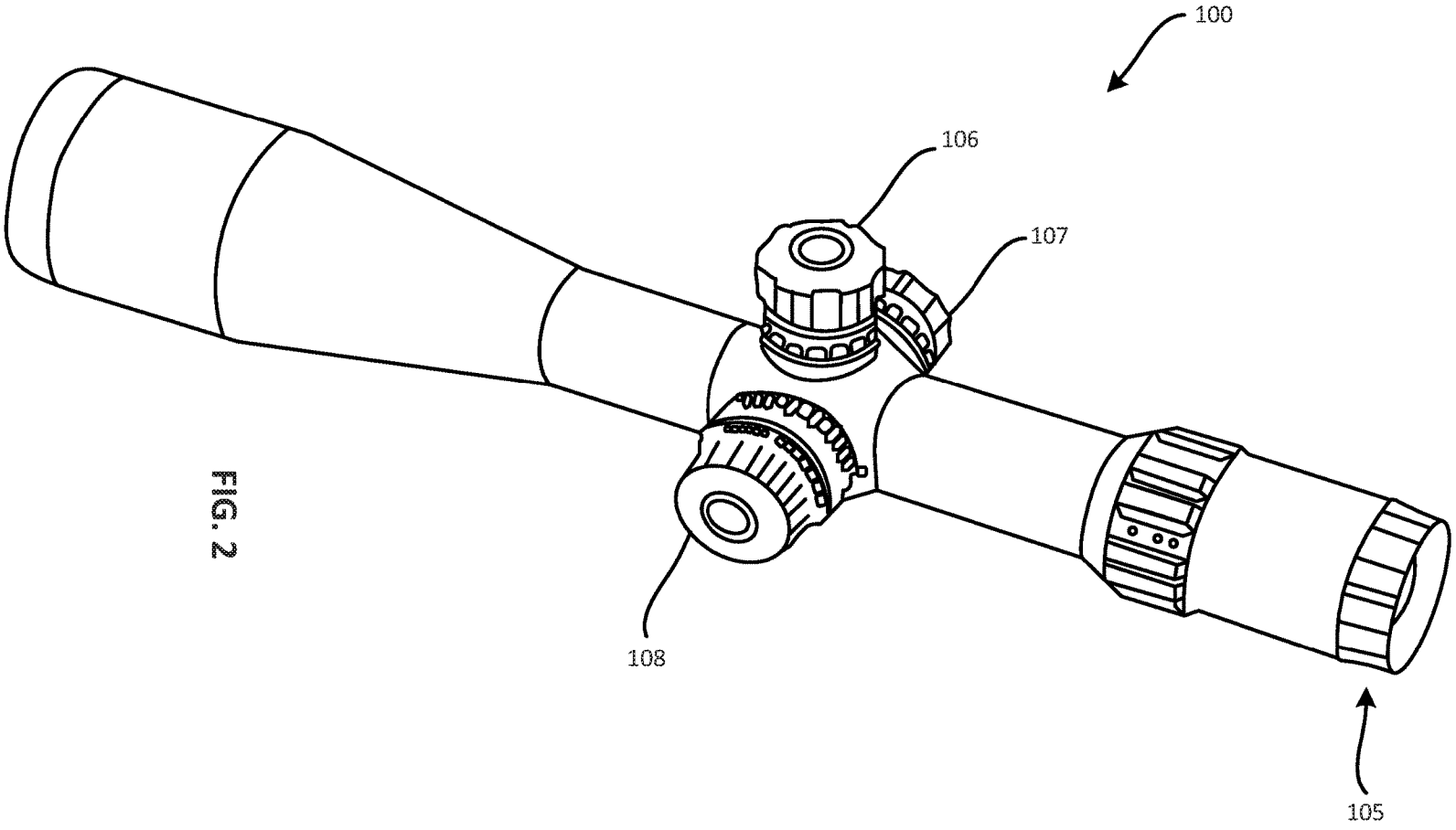
FIG. 2 is a perspective view of the optical sighting system of FIG. 1 shown in isolation.

FIG. 2 is a perspective view of the optical sighting system 100 of FIG. 1 shown in isolation. As illustrated in FIG. 2, the optical sighting system 100 may include an objective end 104, an ocular end 105, an elevation turret 106, a windage turret 107, and an auxiliary turret 108. The objective end 104 of the optical sighting system 100 is typically positioned toward the intended target, while the ocular end 105 is positioned adjacent to the shooter's eye. The elevation turret 106 may be used to adjust the vertical calibration of a reticle 109 (see FIGS. 5-7) within the optical sighting system 100, and the windage turret 107 may be used to adjust the horizontal calibration of the reticle 109. The auxiliary turret 108 may be used to provide other adjustments or manipulations to the optical sighting system 100, such as, for example, a parallax compensation adjustment or an illumination brightness control for an illuminated reticle 109. The auxiliary turret 108 may also house other components as discussed for FIG. 3 below.

Figure 3:
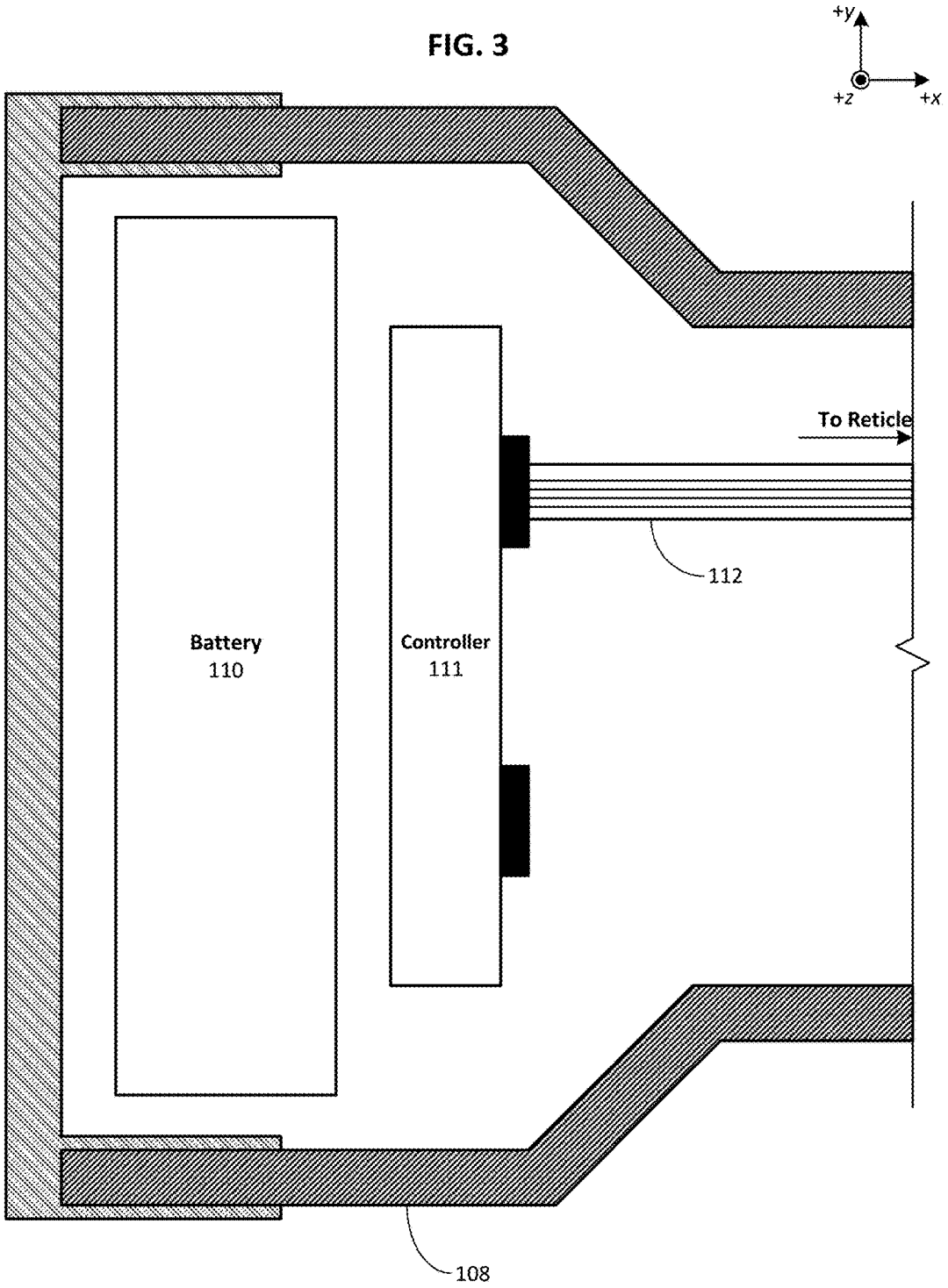
FIG. 3 diagrammatically illustrates selected components that may be included within an auxiliary turret.

FIG. 3 diagrammatically illustrates selected components that may be included inside an auxiliary turret 108. As illustrated in FIG. 3, the auxiliary turret 108 may include a battery 110 and a controller 111. For clarity, FIG. 3 does not show circuits or other electronics that connect the battery 110 to the controller 111, the battery 110 to other components, or the controller 111 to other components, except as discussed here. The battery 110 may be a power source for the controller 111 and for other components of the optical sighting system 100. In embodiments, the controller 111 may be connected to the reticle 109 (for example, through a flexible circuit 112), as described more fully elsewhere in this disclosure. Hence, the controller 111 may enable and control operation of the reticle 109.

Figure 4:
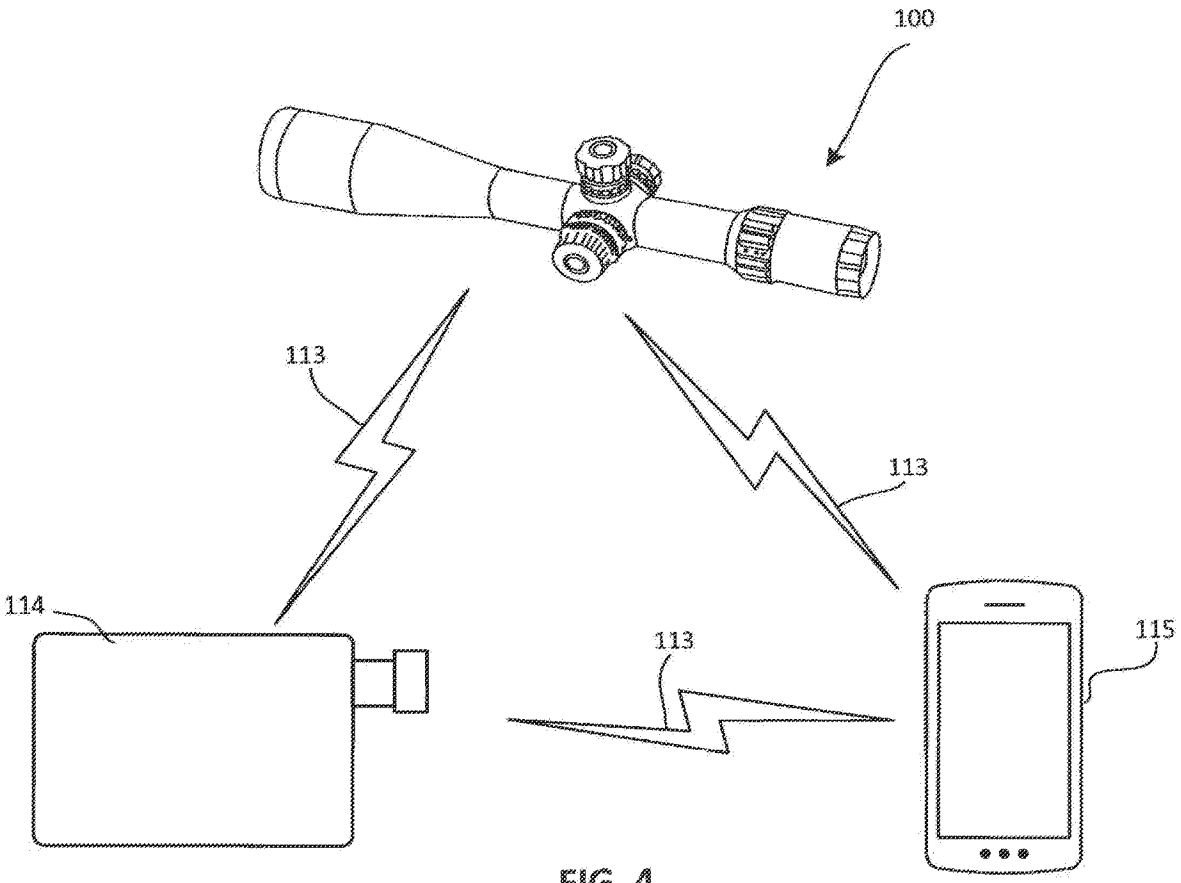
FIG. 4 illustrates an example optical sighting system having a wireless connection with an example rangefinder and an example mobile device.

FIG. 4 illustrates an example optical sighting system 100 having a wireless connection 113 with an example rangefinder 114 and an example mobile device 115 running a mobile application. In some embodiments, the wireless connection 113 may instead be a wired connection. The interconnection of the optical sighting system 100, the rangefinder 114, and the mobile device 115 are described more fully elsewhere in this disclosure.

Figure 5:
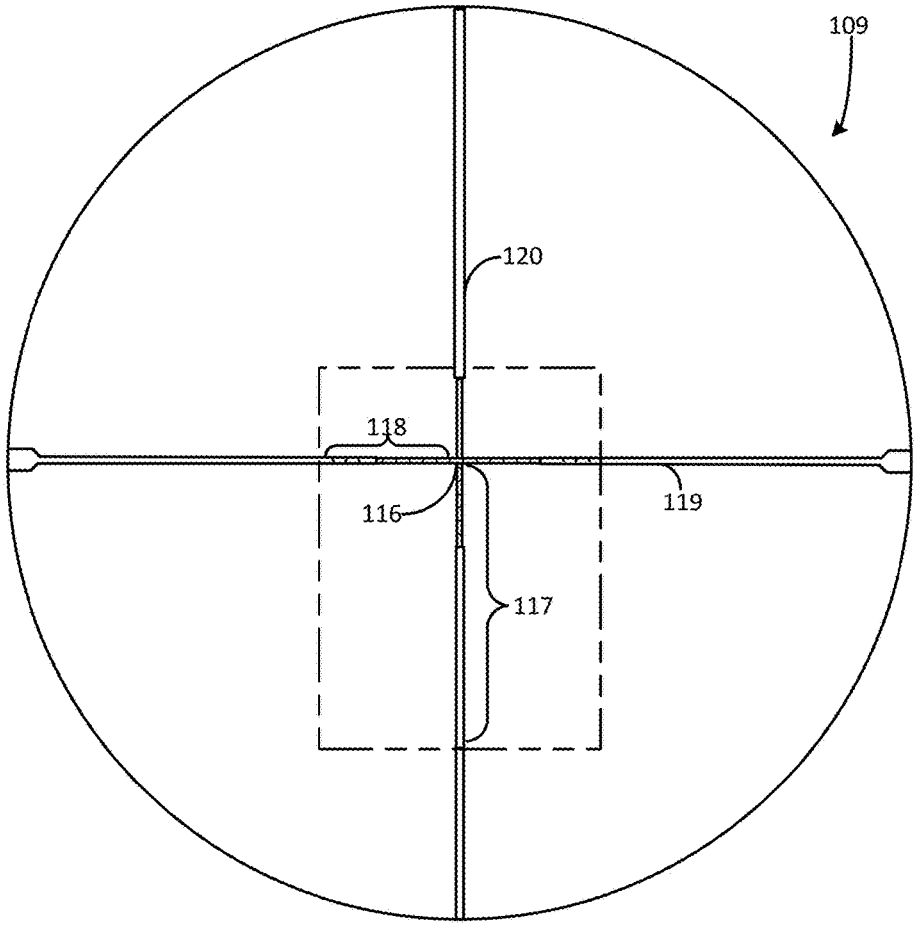
FIG. 5 diagrammatically illustrates an example of a reticle with illuminated hold-over points that may be used in embodiments.
Figure 6:
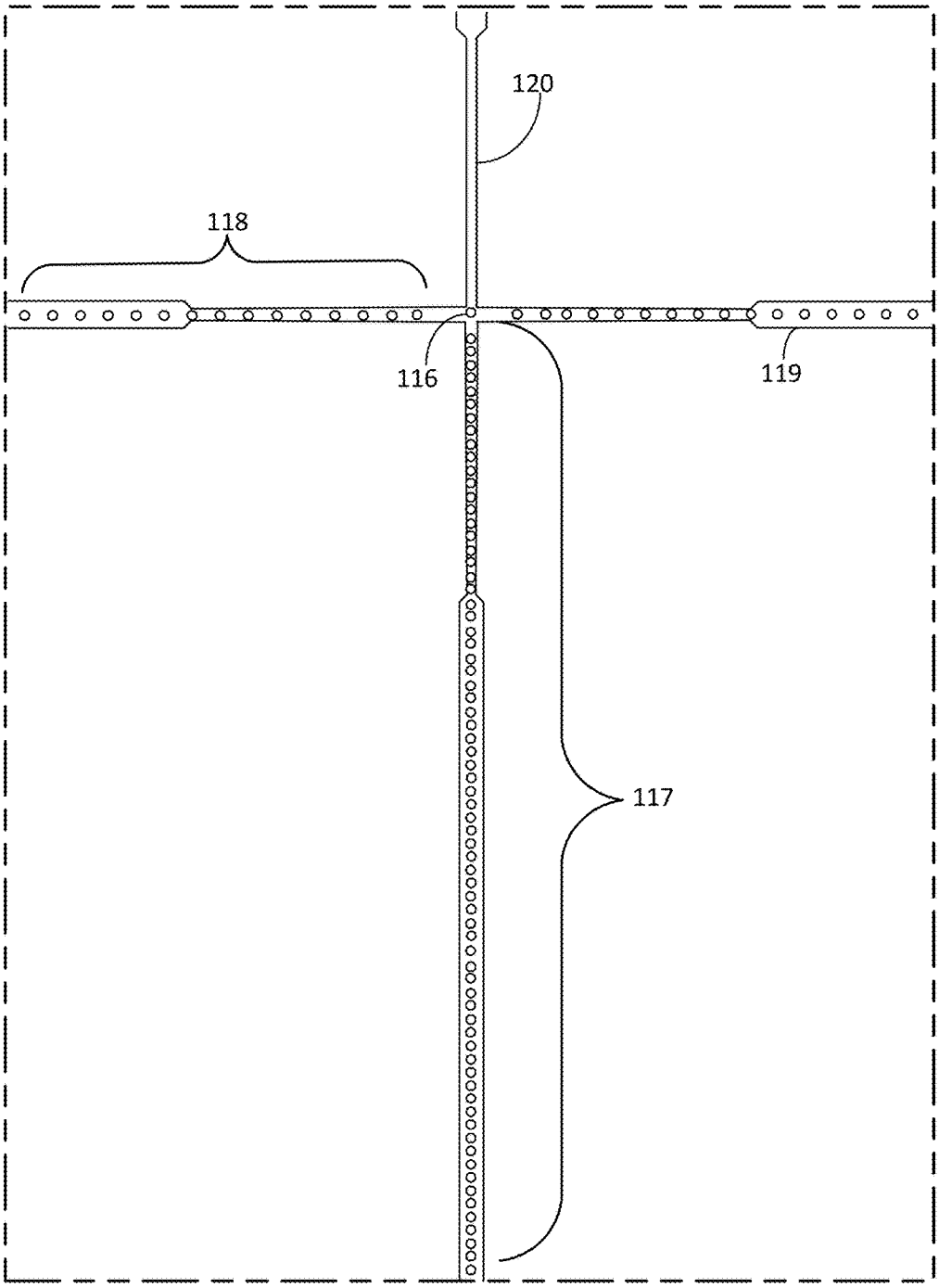
FIG. 6 is a detail view of a portion of the reticle of FIG. 5.

FIG. 5 diagrammatically illustrates an example of a reticle 109 with illuminated hold-over points that may be used with embodiments of the disclosed technology. FIG. 6 is a detail view of a portion of the reticle 109 of FIG. 5. The reticle 109 is shown as it may appear as the shooter looks through the optical sighting system 100 from the ocular end 105 of the optical sighting system 100. As illustrated in FIGS. 5 and 6, the reticle 109 with illuminated hold-over points may include a central LED 116 (light-emitting diode), one or more vertical adjustment LEDs 117, and one or more horizontal adjustment LEDs 118. The LEDs may be, for example, non-transmissive OLEDs (organic light-emitting diode).

The intersection of the horizontal crosshair 119 and the vertical crosshair 120 of the reticle 109 forms a central aiming point, which coincides with the optical axis 102 of the optical sighting system 100. Preferably, the central LED 116 is located at the central aiming point.

A ballistic trajectory is a parabolic curve that begins its initial ascent at the angle of the rifle bore line 103. Due to gravitational forces, the projectile may undergo a certain amount of vertical bullet drop relative to the rifle bore line 103 along the path of the projectile. The ballistic trajectory for the projectile may also vary with environmental conditions, such as crosswind, pressure, temperature, density altitude, humidity, and angle of incline as well as with the projectile's characteristics, such as caliber, bullet weight, ballistic coefficient, and muzzle velocity.

Through a zeroing-in process, the optical sighting system 100, and thus, the optical axis 102 of the optical sighting system 100, may be locked into a position relative to the bore line 103 of the rifle's barrel. Zeroing-in typically includes shooting a fixed target from a known range (for example, 100 yards) and adjusting the position of the riflescope or the reticle 109 within the riflescope (or both) relative to the rifle bore line 103 until the central aiming point of the reticle 109 within the riflescope (see FIG. 5) appears to the shooter to coincide with the actual point of impact on the target. These adjustments to the reticle's position may be made in both the horizontal and vertical directions, using adjustment knobs on the windage turret 107 and the elevation turret 106, respectively.

But for targets at ranges and under environmental conditions that are different from the zeroed-in range and conditions, the shooter may need to compensate for the different range and conditions by, for example, utilizing an electronic ballistics calculator.

That is, for given range, environmental conditions, selected projectile, and other user input information, the electronic ballistics calculator may compute a new ballistic profile for the selected projectile. The electronic ballistics calculator may, for example, use stored G1, G7, or other drag curves, empirically measured data tables, or algorithms for the selected projectile to calculate the amount of vertical bullet drop at any range. The amount of vertical bullet drop may be used to determine an elevation correction—the amount that the optical sighting system 100 should be raised to compensate for the vertical bullet drop. The ballistic profile may include a windage correction—the amount that the optical sighting system 100 should be moved left or right—to compensate for any component of the wind that is perpendicular to the intended path of the projectile.

The electronic ballistics calculator may be, for example, a module of a controller within the optical sighting system 100, such as the controller 111 of FIG. 3. In embodiments, the electronic ballistics calculator may be external to the optical sighting system 100. For example, the mobile application running on the mobile device 115 may include the electronic ballistics calculator as a module. As another example, the digital rangefinder 114 may include the electronic ballistics calculator.

The range to the target may be determined by, for example, the rangefinder 114. The rangefinder 114 may be integrated with the optical sighting system 100, or the rangefinder 114 may be external to the optical sighting system 100, as shown in FIG. 4. The rangefinder 114 may be, for example, a laser rangefinder, such as the KILO1400BDX rangefinder provided by Sig Sauer Inc. or another electronic rangefinder configured to transmit range values determined by the rangefinder. The rangefinder 114 may provide the range measurement through a wired connection or wirelessly, such as through a connection using the BLUETOOTH® wireless technology standard from Bluetooth SIG, Inc. or another radio-frequency (RF) wireless technology. The connection may be to the optical sighting system 100, to the mobile device 115, or to both. (See FIG. 4.)

The mobile application running on the mobile device 115 may include a ballistics solution module configured to use the ballistic profile computed by the electronic ballistics calculator to predict a terminal performance value of the projectile, namely the speed or kinetic energy of the projectile upon arrival at the target.

The mobile application running on the mobile device 115 may also be configured to receive a user input indicative of a desired terminal performance value. In other words, the user may prefer that the projectile have a certain minimum speed or minimum kinetic energy upon arrival at the target. This may be important, for example, to help ensure ethical hunting practices. The minimum speed or minimum kinetic energy sought by the user may be received by the mobile application as the desired terminal performance value.

The mobile application running on the mobile device 115 may also be configured to compare the predicted terminal performance value of the projectile to the desired terminal performance value. In other embodiments, the comparison may be done, for example, by a controller within the optical sighting system 100, such as the controller 111 of FIG. 3.

The optical sighting system 100 may be configured to notify the shooter when the predicted terminal performance value does not exceed the desired terminal performance value. Preferably, the notification is by activating an electronic, non-numeric performance indicator, an example of which is provided below in the discussion of FIG. 7.

The optical sighting system 100 may also be configured to receive a user input to turn on the notification function. In other words, the function of notifying the shooter of whether the predicted terminal performance value does not exceed the desired terminal performance value may be selectively turned on or off. In embodiments, the user input to turn on the notification function may be through, for example, the mobile application running on the mobile device 115.

Returning to the example reticle 109 of FIGS. 5 and 6, the vertical adjustment LEDs 117 and the horizontal adjustment LEDs 118 may convey to the shooter elements of the ballistic profile determined by the electronic ballistics calculator. For example, the vertical adjustment LEDs 117 and the horizontal adjustment LEDs 118 may be addressable and selectively lit by a controller, such as the controller 111 of FIG. 3. Specifically, the elevation correction and windage correction, if any, determined by the electronic ballistics calculator may be displayed in the reticle 109 by illuminating one of the vertical adjustment LEDs 117 to indicate the elevation correction and one of the horizontal adjustment LEDs 118 to indicate the windage correction. The LEDs that are lit, known as the hold-over points, provide the aiming adjustment points for the user. The aiming adjustment points indicate to the user how far along the horizontal direction, the vertical direction, or both, to shift the central aiming point to align over the desired point of impact on the target.

Figure 7:
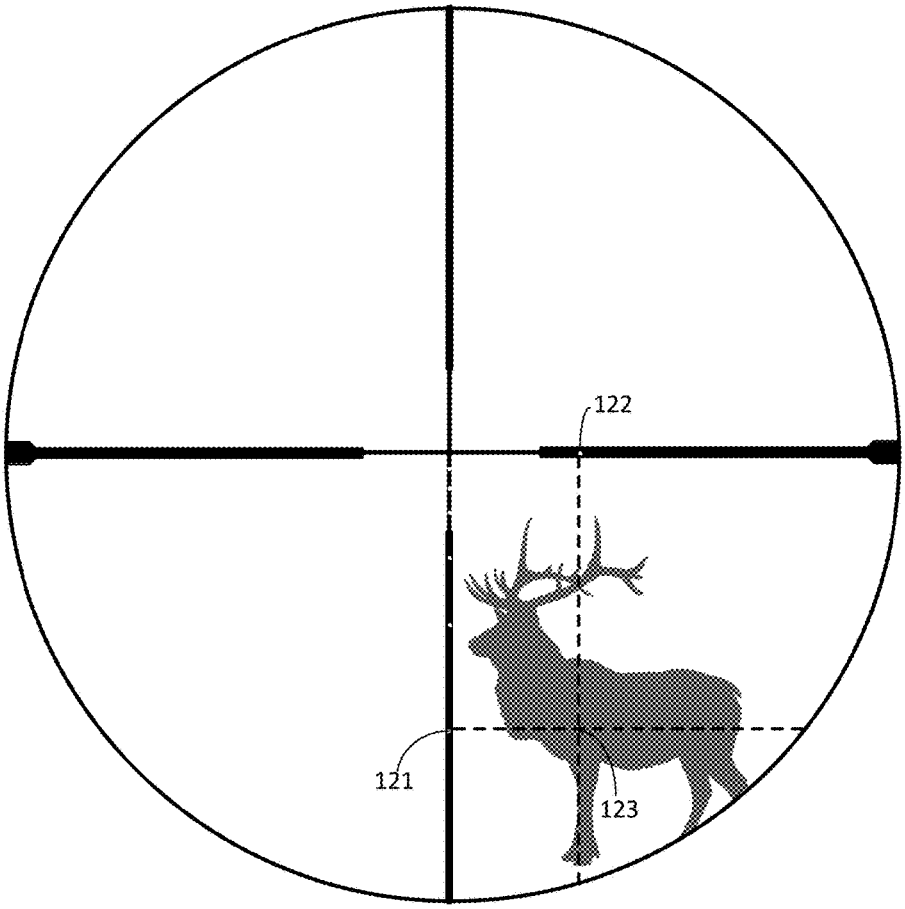
FIG. 7 diagrammatically illustrates an example reticle with an intended target visible through the reticle.

FIG. 7 diagrammatically illustrates an example reticle, such as the reticle 109 of FIGS. 5 and 6, with an intended target (depicted as an elk) visible through the reticle 109. As shown in FIG. 7, the reticle has an LED lit along the vertical crosshair 120 to indicate a vertical aiming adjustment point 121, or vertical hold-over point, and an LED lit along the horizontal crosshair 119 to indicate a horizontal aiming adjustment point 122, or horizontal hold-over point. The spot where the vertical aiming adjustment point 121 intersects with the horizontal aiming adjustment point 122 (indicated by the junction 123 of the dashed lines in FIG. 7) is the aiming adjustment point that the shooter should align over the desired point of impact on the target.

In embodiments, the LEDs at one or both of the hold-over points (the vertical aiming adjustment point 121 or the horizontal aiming adjustment point 122) may be intermittently displayed when the predicted terminal performance value does not exceed the desired terminal performance value. For example, one or both of the hold-over points may flash at an interval of, for example, every two seconds. Other intervals could also be used. This provides a visual, non-numeric notice to the shooter that the shooter may want to take additional steps to ensure that the terminal performance of the projectile meets the minimum desired by the shooter. So, for example, the shooter might move closer to the intended target. Preferably, the notice is non-numeric, meaning that the shooter will not need to remember the desired terminal performance value and manually compare that to, for example, a predicted terminal performance value appearing as a number within the reticle while a desirable target is visible in the reticle. By contrast, embodiments of the disclosed technology allow the desired terminal performance value to be preset, before the shooter takes aim at an intended target, permitting an active reminder of the desired terminal performance value once the shooter does aim at the target.

Accordingly, embodiments of the disclosed technology may make it easier for the shooter to make an ethical choice while hunting. Specifically, the shooter need not remember the desired terminal speed or kinetic energy in the (likely thrilling) moment of aiming a riflescope at an intended target. Moreover, a non-numeric indicator, particularly one that is actively flashing, may be more difficult for the shooter to ignore than, for example, a number passively appearing within the reticle.

Figure 8:
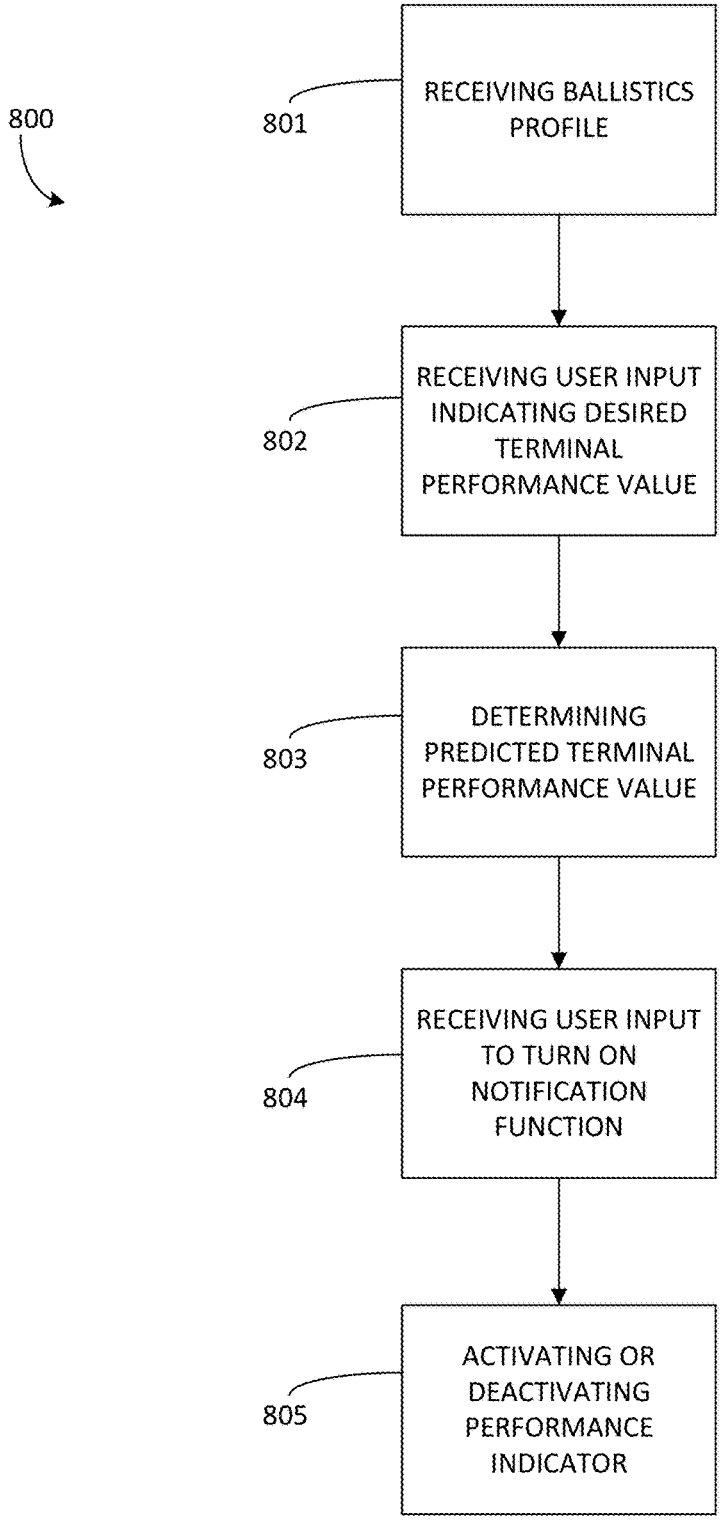
FIG. 8 illustrates an example method of indicating an energy transfer level in an optical sighting system.

FIG. 8 illustrates an example method of indicating an energy transfer level in an optical sighting system. As illustrated in FIG. 8, a method of indicating an energy transfer level in an optical sighting system may include: receiving 801 a ballistics profile indicating a calculated path of a projectile to be fired from the shooting device toward a target; receiving 802, through a mobile application running on a mobile device external to the optical sighting system, a user input indicative of a desired terminal performance value for the projectile; determining 803 a predicted terminal performance value of the projectile based, at least in part, on the ballistics profile; activating 805, when the predicted terminal performance value does not exceed the desired terminal performance value, an electronic, non-numeric performance indicator structured to provide a notification signal to a user; and deactivating 805 the electronic, non-numeric performance indicator when the predicted terminal performance value exceeds the desired terminal performance value.

The method 800 may also include receiving 804 a user input to turn on a notification function, and then turning on the notification function before activating, when the predicted terminal performance value does not exceed the desired terminal performance value, the electronic, non-numeric performance indicator.

In embodiments, receiving 801 the ballistics profile includes receiving the ballistics profile from an electronic ballistics calculator external to the optical sighting system.

In embodiments, a non-transitory computer-readable medium may have computer-executable instructions stored thereon that, in response to execution by a computing device, cause the computing device to perform operations, the operations including: receiving a ballistics profile indicating a calculated path of a projectile to be fired from the shooting device toward a target; receiving, through a mobile application running on a mobile device external to the optical sighting system, a user input indicative of a desired terminal performance value for the projectile; determining a predicted terminal performance value of the projectile based, at least in part, on the ballistics profile; activating, when the predicted terminal performance value does not exceed the desired terminal performance value, an electronic, non-numeric performance indicator structured to provide a notification signal to a user; and deactivating the electronic, non-numeric performance indicator when the predicted terminal performance value exceeds the desired terminal performance value.

Computer-readable media means any media that can be accessed by a computing device. By way of example, and not limitation, computer-readable media may comprise computer storage media and communication media.

Computer storage media means any medium that can be used to store computer-readable information. By way of example, and not limitation, computer storage media may include RAM, ROM, EEPROM, flash memory or other memory technology, CD-ROM, DVD or other optical disk storage, magnetic cassettes, magnetic tape, magnetic disk storage or other magnetic storage devices, and any other volatile or nonvolatile, removable or non-removable media implemented in any technology. Computer storage media excludes signals per se and transitory forms of signal transmission.

Communication media means any media that can be used for the communication of computer-readable information. By way of example, and not limitation, communication media may include coaxial cables, fiber-optic cables, air, or any other media suitable for the communication of electrical, optical, RF, infrared, acoustic or other types of signals.

Consequently, embodiments of the disclosed technology allow shooters to easily make ethical choices while hunting by notify the shooter if the calculated terminal performance is less than the shooter's desired terminal performance.

EXAMPLES

Illustrative examples of the disclosed technologies are provided below. An embodiment of the technologies may include one or more, and any combination of, the examples described below.

Example 1 includes a method of indicating an energy transfer level in an optical sighting system, the optical sighting system having a main optical axis extending from an ocular end to an objective end of the optical sighting system, the main optical axis being fixedly aligned with a bore line of a shooting device, the method comprising: receiving a ballistics profile indicating a calculated path of a projectile to be fired from the shooting device toward a target; receiving, through a mobile application running on a mobile device external to the optical sighting system, a user input indicative of a desired terminal performance value for the projectile; determining a predicted terminal performance value of the projectile based, at least in part, on the ballistics profile; activating, when the predicted terminal performance value does not exceed the desired terminal performance value, an electronic, non-numeric performance indicator structured to provide a notification signal to a user; and deactivating the electronic, non-numeric performance indicator when the predicted terminal performance value exceeds the desired terminal performance value.

Example 2 includes the method of Example 1, in which the electronic, non-numeric performance indicator is an element in a reticle of the optical sighting system.

Example 3 includes the method of Example 1, in which the electronic, non-numeric performance indicator is a flashing element in a digital reticle of the optical sighting system.

Example 4 includes the method of Example 3, in which the flashing element is a hold-over point indicator.

Example 5 includes the method of any of Examples 1-4, in which the desired terminal performance value is a desired kinetic energy of the projectile at the target.

Example 6 includes the method of any of Examples 1-4, in which the desired terminal performance value is a desired speed of the projectile at the target.

Example 7 includes the method of any of Examples 1-6, further comprising receiving a user input to turn on a notification function, and then turning on the notification function before activating, when the predicted terminal performance value does not exceed the desired terminal performance value, the electronic, non-numeric performance indicator.

Example 8 includes the method of any of Examples 1-7, in which receiving the ballistics profile comprises receiving the ballistics profile from an electronic ballistics calculator external to the optical sighting system.

Example 9 includes the method of any of Examples 1-8, in which the mobile application includes the electronic ballistics calculator.

Example 10 includes the method of any of Examples 1-8, in which a digital rangefinder includes the electronic ballistics calculator.

Example 11 includes a non-transitory computer-readable medium having computer-executable instructions stored thereon that, in response to execution by a computing device, cause the computing device to perform operations, the operations comprising: receiving a ballistics profile indicating a calculated path of a projectile to be fired from the shooting device toward a target; receiving, through a mobile application running on a mobile device external to the optical sighting system, a user input indicative of a desired terminal performance value for the projectile; determining a predicted terminal performance value of the projectile based, at least in part, on the ballistics profile; activating, when the predicted terminal performance value does not exceed the desired terminal performance value, an electronic, non-numeric performance indicator structured to provide a notification signal to a user; and deactivating the electronic, non-numeric performance indicator when the predicted terminal performance value exceeds the desired terminal performance value.

Example 12 includes the medium of Example 11, in which the electronic, non-numeric performance indicator is an element in a reticle of the optical sighting system.

Example 13 includes the medium of Example 11, in which the electronic, non-numeric performance indicator is a flashing element in a reticle of the optical sighting system.

Example 14 includes the medium of Example 13, in which the flashing element is a hold-over point indicator.

Example 15 includes the medium of any of Examples 11-14, in which the desired terminal performance value is a desired kinetic energy of the projectile at the target.

Example 16 includes the medium of any of Examples 11-14, in which the desired terminal performance value is a desired speed of the projectile at the target.

Example 17 includes a system for indicating an energy transfer level, the system comprising: an optical sighting system having a main optical axis extending from an ocular end to an objective end of the optical sighting system, the main optical axis being fixedly aligned with a bore line of a shooting device, and an electronic, non-numeric performance indicator structured to provide a notification signal to a user, the optical sighting system configured to receive a ballistics profile indicating a calculated path of a projectile to be fired from the shooting device toward a target, the optical sighting system configured to determine a predicted terminal performance value of the projectile based, at least in part, on the ballistics profile; and a mobile application running on a mobile device external to the optical sighting system, the mobile application configured to receive a user input indicative of a desired terminal performance value for a projectile and to transmit a signal corresponding to the user input, the optical lighting system further configured to receive the signal corresponding to the user input, to activate, when the predicted terminal performance value does not exceed the desired terminal performance value, the electronic, non-numeric performance indicator; and, to deactivate the electronic, non-numeric performance indicator when the predicted terminal performance value exceeds the desired terminal performance value.

Example 18 includes the system of Example 17, in which the electronic, non-numeric performance indicator is an element in a reticle of the optical sighting system.

Example 19 includes the system of Example 17, in which the electronic, non-numeric performance indicator is an intermittently displayed element in a reticle of the optical sighting system.

Example 20 includes the system of Example 19, in which the intermittently displayed element is a hold-over point indicator.

Embodiments may operate on a particularly created hardware, on firmware, digital signal processors, or on a specially programmed general-purpose computer including a processor operating according to programmed instructions. The terms "controller" or "processor" as used herein are intended to include microprocessors, microcomputers, ASICs, and dedicated hardware controllers. One or more aspects may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular data types when executed by a processor in a computer or other device. The computer executable instructions may be stored on a non-transitory computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the disclosed systems and methods, and such data structures are contemplated within the scope of computer executable instructions and computer-usable data described herein.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical" and "horizontal" are used for convenience and in reference to the views provided in figures. But the disclosed components may have a number of orientations in actual use. Thus, a feature that is vertical or horizontal in the figures may not have that same orientation or direction in actual use.

Although specific embodiments have been illustrated and described for purposes of illustration, it will be understood that various modifications may be made without departing from the spirit and scope of the disclosure.

The invention claimed is:

1. A method of indicating an energy transfer level in an optical sighting system, the optical sighting system having a main optical axis extending from an ocular end to an objective end of the optical sighting system, the main optical axis being fixedly aligned with a bore line of a shooting device, the method comprising:

receiving, from an electronic ballistics calculator, a ballistics profile indicating a calculated path of a projectile to be fired from the shooting device toward a target;

receiving, through a mobile application running on a mobile device external to the optical sighting system, a user input indicative of a desired terminal performance value for the projectile;

determining, by the mobile application, a predicted terminal performance value of the projectile based, at least in part, on the ballistics profile;

activating, when the predicted terminal performance value does not exceed the desired terminal performance value, an electronic, non-numeric performance indicator structured to provide a notification signal to a user; and deactivating the electronic, non-numeric performance indicator when the predicted terminal performance value exceeds the desired terminal performance value.

2. The method of claim 1, in which the electronic, non-numeric performance indicator is an element in a reticle of the optical sighting system.

3. The method of claim 1, in which the electronic, non-numeric performance indicator is a flashing element in a digital reticle of the optical sighting system.

4. The method of claim 3, in which the flashing element is a hold-over point indicator.

5. The method of claim 1, in which the desired terminal performance value is a desired kinetic energy of the projectile at the target.

6. The method of claim 1, in which the desired terminal performance value is a desired speed of the projectile at the target.

7. The method of claim 1, further comprising receiving a user input to turn on a notification function, and then turning on the notification function before activating, when the predicted terminal performance value does not exceed the desired terminal performance value, the electronic, non-numeric performance indicator.

8. The method of claim 1, in which a controller within the optical sighting system includes the electronic ballistics calculator.

9. The method of claim 1, in which the mobile application includes the electronic ballistics calculator.

10. The method of claim 1, in which a digital rangefinder includes the electronic ballistics calculator.

11. A non-transitory computer-readable medium having computer-executable instructions stored thereon that, in response to execution by a computing device, cause the computing device to perform operations, the operations comprising:

receiving, from an electronic ballistics calculator, a ballistics profile indicating a calculated path of a projectile to be fired from a shooting device toward a target;

receiving, through a mobile application running on a mobile device external to a optical sighting system, a user input indicative of a desired terminal performance value for the projectile;

determining, by the mobile application, a predicted terminal performance value of the projectile based, at least in part, on the ballistics profile;

activating, when the predicted terminal performance value does not exceed the desired terminal performance value, an electronic, non-numeric performance indicator structured to provide a notification signal to a user; and deactivating the electronic, non-numeric performance indicator when the predicted terminal performance value exceeds the desired terminal performance value.

12. The medium of claim 11, in which the electronic, non-numeric performance indicator is an element in a reticle of the optical sighting system.

13. The medium of claim 11, in which the electronic, non-numeric performance indicator is a flashing element in a reticle of the optical sighting system.

14. The medium of claim 13, in which the flashing element is a hold-over point indicator.

15. The medium of claim 11, in which the desired terminal performance value is a desired kinetic energy of the projectile at the target.

16. The medium of claim 11, in which the desired terminal performance value is a desired speed of the projectile at the target.

17. A system for indicating an energy transfer level, the system comprising:

an optical sighting system having a main optical axis extending from an ocular end to an objective end of the optical sighting system, the main optical axis being fixedly aligned with a bore line of a shooting device, and an electronic, non-numeric performance indicator structured to provide a notification signal to a user, the optical sighting system configured to receive a ballistics profile from an electronic ballistics calculator indicating a calculated path of a projectile to be fired from the shooting device toward a target; and a mobile application running on a mobile device external to the optical sighting system, the mobile application configured to determine a predicted terminal performance value of the projectile based, at least in part, on the ballistics profile, the mobile application further configured to receive a user input indicative of a desired terminal performance value for a projectile and to transmit a signal corresponding to the user input, the optical sighting system further configured to receive the signal corresponding to the user input, to activate, when the predicted terminal performance value does not exceed the desired terminal performance value, the electronic, non-numeric performance indicator; and, to deactivate the electronic, non-numeric performance indicator when the predicted terminal performance value exceeds the desired terminal performance value.

18. The system of claim 17, in which the electronic, non-numeric performance indicator is an element in a reticle of the optical sighting system.

19. The system of claim 17, in which the electronic, non-numeric performance indicator is an intermittently displayed element in a reticle of the optical sighting system.

20. The system of claim 19, in which the intermittently displayed element is a hold-over point indicator.

* * * * *